US005549522A

United States Patent [19]

Chang

[11] Patent Number: 5,549,522

[45] Date of Patent: Aug. 27, 1996

[54] GOLF PRACTICING DEVICE

[76] Inventor: Po-neng Chang, No. 38, 36th Rd., Industrial Dist., Taichung, Taiwan

[21] Appl. No.: 582,520

[22] Filed: Jan. 3, 1996

[51] Int. Cl.[6] ..... A63B 69/36

[52] U.S. Cl. ..... 473/279; 108/4

[58] Field of Search ..... 473/278, 279, 473/160, 161; 273/195 B, 195 R, 176 H; 108/1, 4

[56] References Cited

U.S. PATENT DOCUMENTS

| | | | |
|---|---|---|---|
| 3,430,964 | 3/1969 | Budzinski | 473/279 |
| 3,595,581 | 7/1971 | Anderson et al. | 473/161 |
| 4,374,497 | 2/1983 | Harmond | 108/4 |
| 5,358,251 | 10/1994 | Ashton | 473/279 |
| 5,431,406 | 7/1995 | Ishii | 473/279 |

FOREIGN PATENT DOCUMENTS

| | | | |
|---|---|---|---|
| 5192430 | 8/1993 | Japan | 273/195 B |
| 6285202 | 10/1994 | Japan | 273/195 B |

*Primary Examiner*—Mark S. Graham
*Attorney, Agent, or Firm*—Kirkpatrick & Lockhart LLP

[57] ABSTRACT

A practicing device includes an upper plate, a lower plate and at least one adjusting device disposed therebetween, a support extending from the lower plate and a stand extending from an under side of the upper plate so as to be rotatably received in the support with a distal end of the stand, the adjusting device including a first base disposed to the lower plate and a second base disposed to the upper plate, a cup having a bottom with a stand extending therefrom and an open top, a worm gear disposed in the cup and having a threaded hole defined therein for a threaded rod threadedly engaged therethrough, a first ball formed to a distal end of the stand for being rotatably received in the first base and one end of the threaded rod having a second ball formed thereto for being rotatably received in the second base, a motor-driven worm screw laterally extending through the cup and engaged with the worm gear so as to lift or lower the threaded rod to adjust the upper plate corresponding to the lower plate such that a player may hit a golf ball when standing on the upper plate.

2 Claims, 4 Drawing Sheets

GOLF PRACTICING DEVICE

BACKGROUND OF THE INVENTION

The present invention relates to a golf practicing device and more particularly, to a golf practicing device which can establish a variety of situations which usually occur when playing golf such that a player is able to practice even when not at a golf course.

Golf is a popular exercise which needs a certain skill for a player to play satisfactorily, therefore, a frequent practicing of different situations is needed. As a golf course includes different topographies, such as downward slopes or upward slopes, the player has to possess a control ability to hit a golf ball on any topographies. Most players practice their skill at a practice range in which the player can only to hit the ball on a tee inserted in a teeing ground and although that provides the player a chance to practice using some certain clubs, such as #1–3 woods and most iron clubs, however, an important putter (#8) generally can not used in such a practice range because the practice range does not have varying topographies.

The present invention intends to provide a golf practicing device which includes an upper plate and a lower plate, two adjusting means disposed therebetween such that the upper plate can be adjusted to an angle corresponding to the lower plate for a player standing on the upper plate to play a golf ball as like standing on a real golf course.

SUMMARY OF THE INVENTION

The present invention provides a golf practicing device which includes an upper plate upon which players stand, a lower plate and at least one adjusting means disposed therebetween, the adjusting means including a cup which has stand extending from a bottom thereof and the stand is rotatably received in a first base on the lower plate, a worm gear disposed in the cup and having a threaded hole defined therein for receiving a threaded rod threadedly engaged therethrough, the threaded rod having an end with a second ball formed thereto so as to be rotatably received in a second base on the upper plate and a motor-driven worm screw extending through the cup and engaged with the worm gear, a support extending from the lower plate and a supporting rod extending from the upper plate such that a third ball is formed to a distal end of the supporting rod so as to be rotatably received in the support such that when the adjusting means is operated, the upper plate is adjusted inclinedly corresponding to the lower plate.

It is an object of the present invention to provide a golf practicing device so as to establish different slopes just like in a real golf course.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
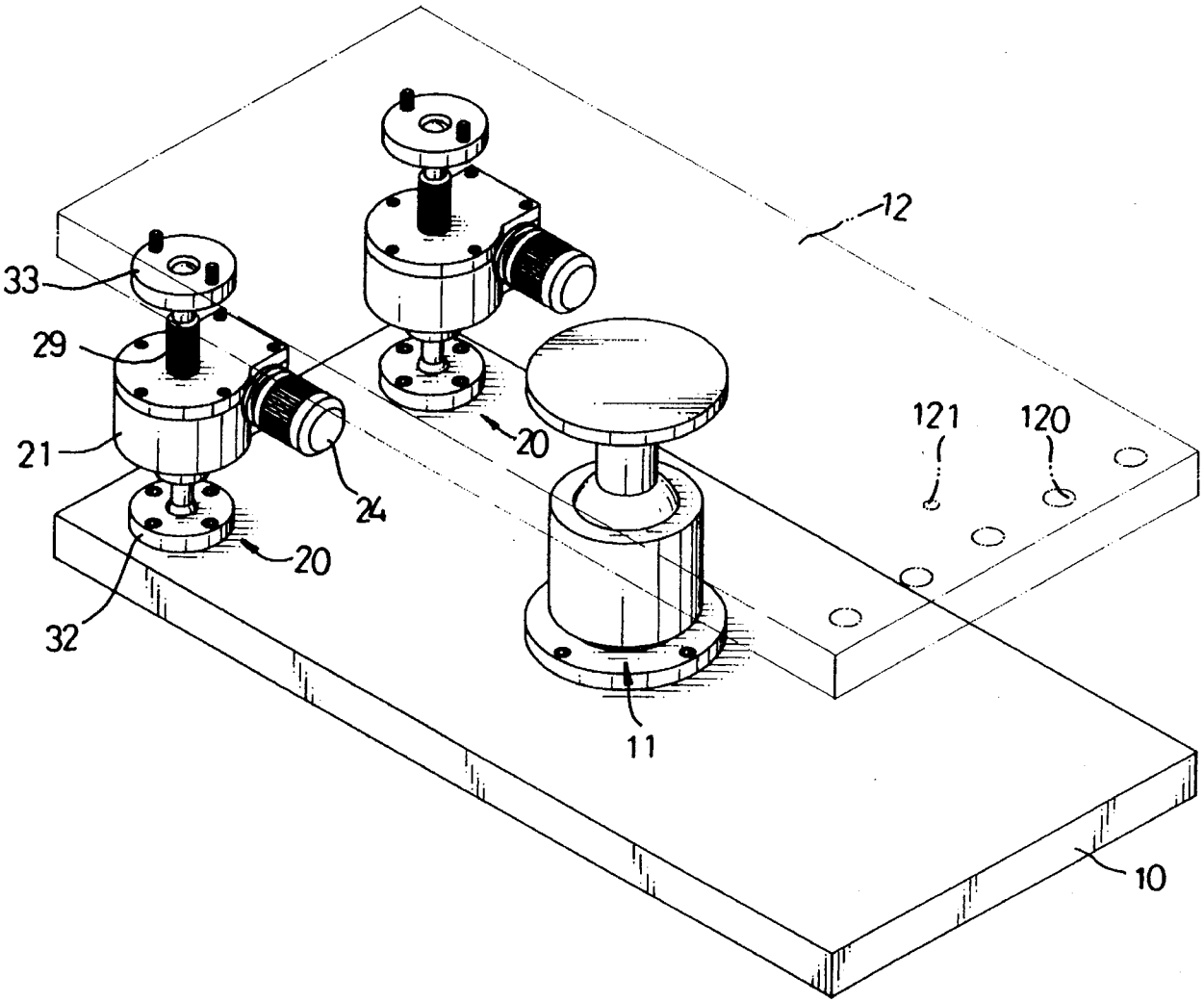
FIG. 1 is a perspective view of a golf practicing device in accordance with the present invention wherein an upper plate is shown in phantom lines.
Figure 2:
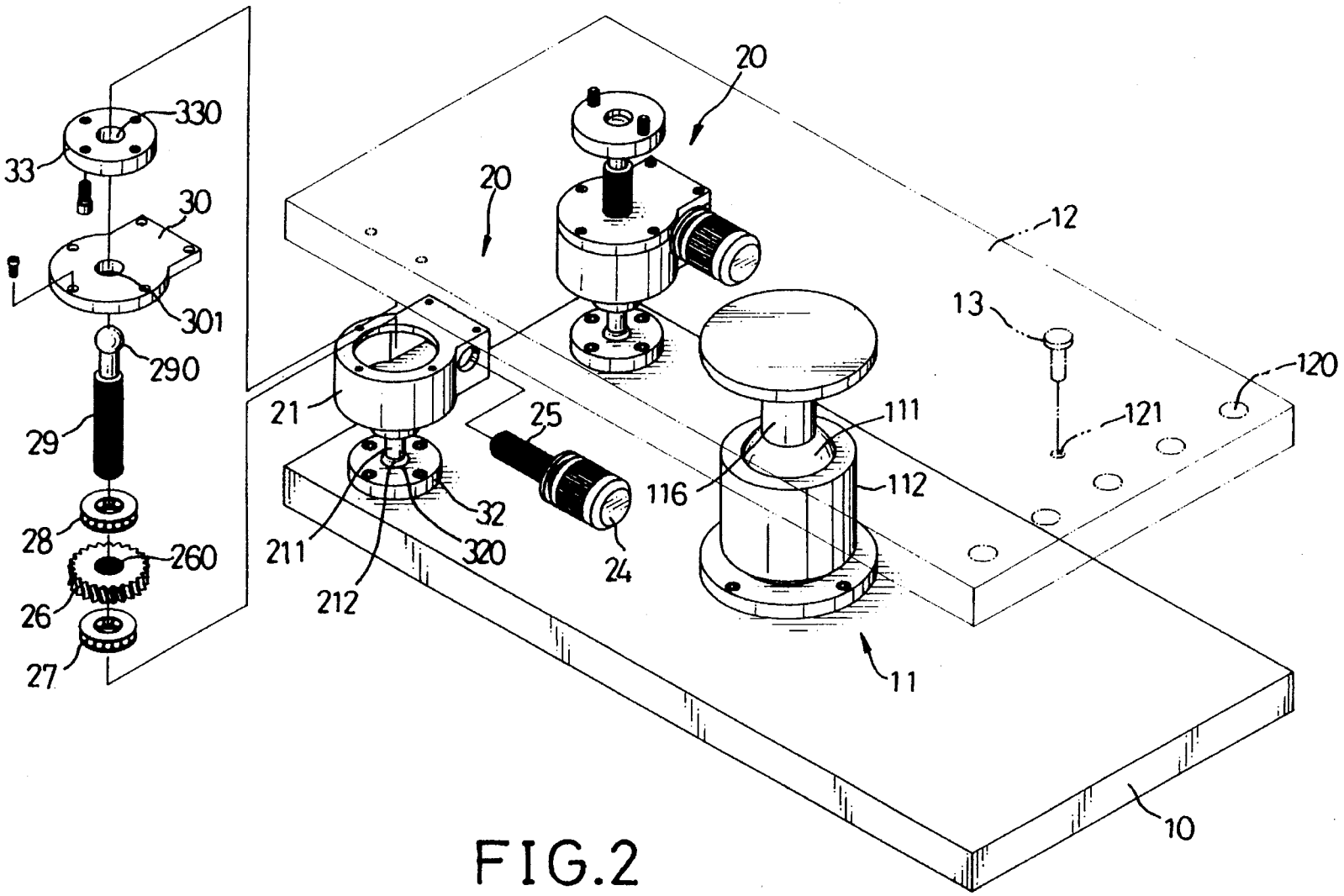
FIG. 2 is an exploded view of the golf practicing device in accordance with the present invention.
Figure 3:
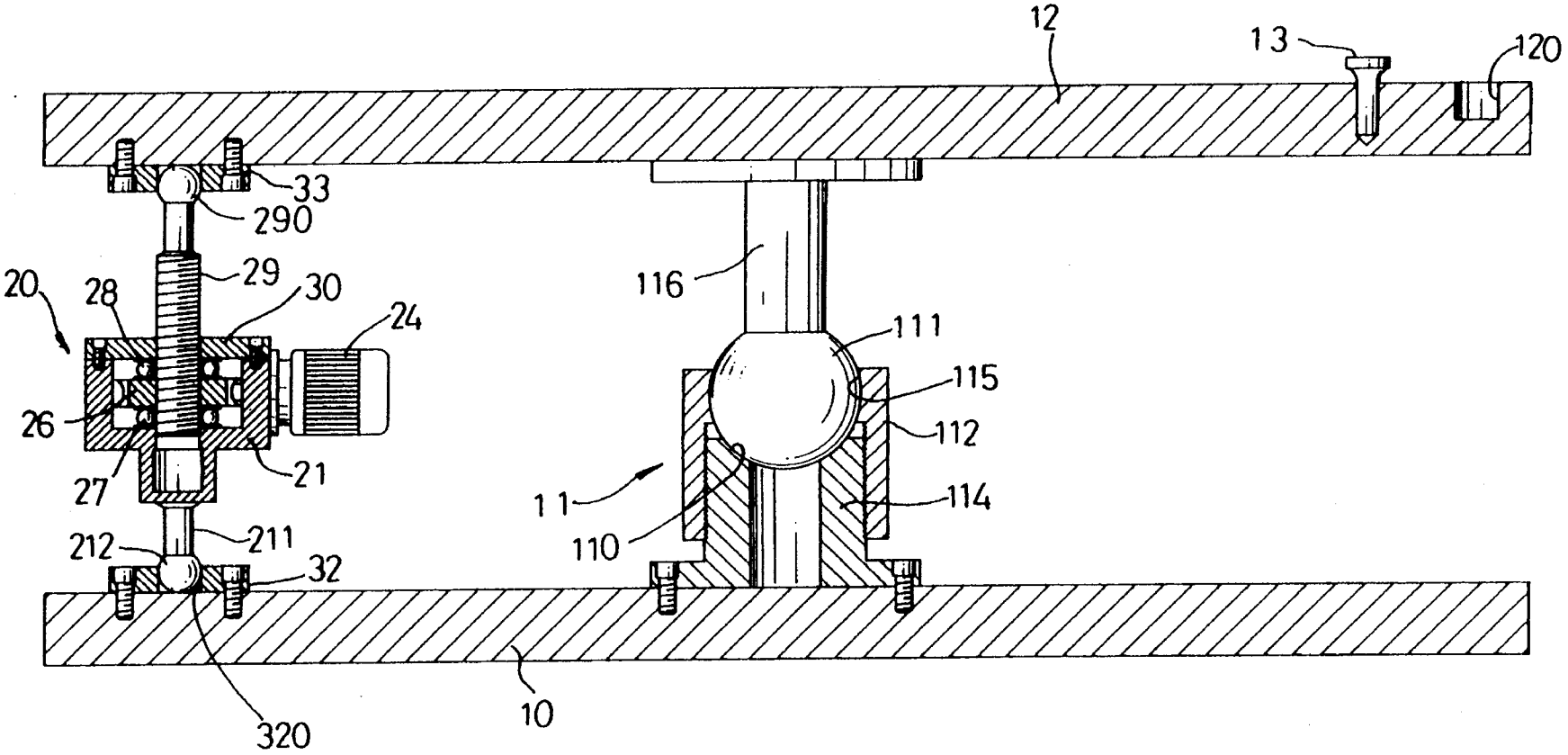
FIG. 3 is a side elevational view, partly in section, of the golf practicing device in according to the present invention.

Referring to the drawings and initially to FIGS. 1 through 3, a golf practicing device in accordance with the present invention generally includes a lower plate 10, an upper plate 12 and two adjusting means 20 disposed between the lower plate 10 and the upper plate 12. The upper plate 12 has a plurality of holes 120 defined in an upper surface thereof and a tee hole 121 for inserting a tee 13 therein.

The two adjusting means 20 are disposed on the lower plate 10 and each comprises a cup 21 having an open top and a bottom, a stand 211 extending from the bottom and having a first ball 212 formed to a distal end thereof. A first base 32 is fixedly engaged to the lower plate 10 by bolts extending through the first base 32 and the lower plate 10 and has a first hole 320 for receiving the first ball 212 therein such that the cup 21 can be rotated about the first ball 212. A worm gear 26 is rotatably received in the cup 21 by disposing a bearing 27/28 to a lower end and an upper end thereof and has a threaded hole 260 defined centrally therein.

A cap 30 is engaged to close the open top of the cup 21 and has a central hole 301 defined therein. A threaded rod 29 is engaged through the worm gear 26 by a first end thereof and has with a second end extending through the cap 30 via the central hole 301. The threaded rod 29 has a second ball 290 formed to the second end thereof. A second base 33 is fixedly engaged to an under side of the upper plate 12 and the second ball 290 of the threaded rod 29 is received in a second hole 330 defined in the second base 33. A worm screw 25 extends laterally through the cup 21 so as to engage with the worm gear 26 and the worm screw 25 is driven by a motor 24.

A support 11 extends from the lower plate 10 and comprises a base element 114 and a mounting element 112 which is threadedly mounted to the base element 114, the base element 114 having a receiving portion 110 defined therein and the mounting element having a central hole 115 defined therein. A supporting rod 116 extends from the under side of the upper plate 12 and has a third ball 111 formed to a distal end thereof so as to be received in the receiving portion 110 via the central hole 115.

Figure 4:
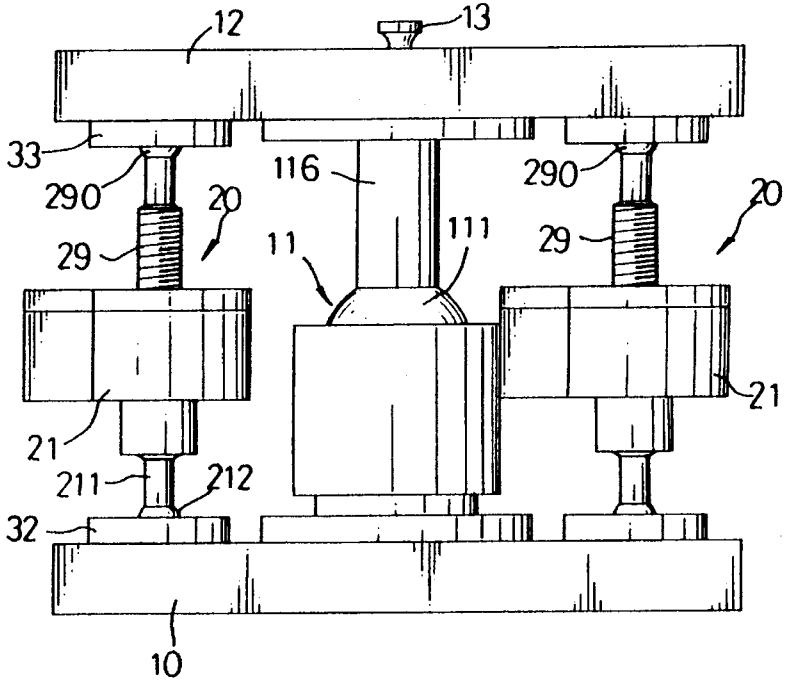
FIG. 4 is a front plan view of the golf practicing device in according to the present invention.
Figure 5:
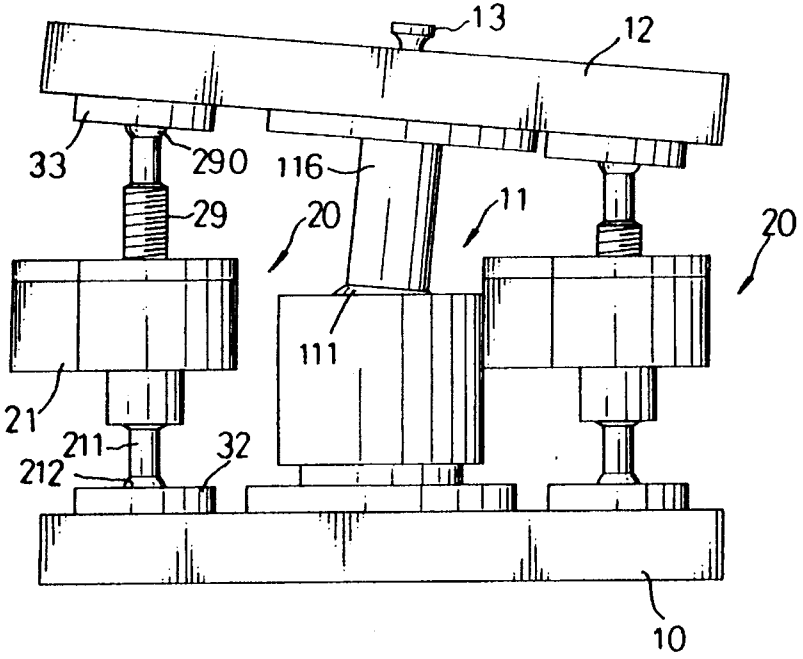
FIG. 5 is a view similar to FIG. 4 wherein two adjusting means disposed between the upper and the lower plates are actuated.

Referring now to FIGS. 4 and 5, when using the device, a player stands on the upper plate 12 and practices a swing, or the player actuates the motor 24 to operate the worm screw 25 such that the corresponding worm gear 26 is rotated so as to adjust the threaded rod 29 up or down such that the upper plate 12 is inclined to the lower plate 10, then the player can practice a skill of using the putter.

Accordingly, the present invention provides a golf practicing device such that players can operate the device to imitate different situations or slopes just like playing on a real golf course.

Although the invention has been explained in relation to its preferred embodiment, it is to be understood that many other possible modifications and variations can be made without departing from the spirit and scope of the invention as hereinafter claimed.

I claim:

1. A golf practicing device comprising:

a lower plate, an upper plate and at least one adjusting means disposed between said lower plate and said upper plate;

said adjusting means disposed on said lower plate, said adjusting means comprising a cup having an open top and a bottom, a stand extending from said bottom and having a first ball formed to a distal end thereof, a first base fixedly engaged to said lower plate and having a first hole for receiving said first ball therein, a worm gear being rotatably received in said cup and having a threaded hole defined centrally therein, a cap engaged to close said open top of said cup and having a central hole defined therein, a threaded rod having a first end threadedly engaged through said worm gear and a second end extending through said cap via said central hole, said threaded rod having a second ball formed to said second end thereof, a second base fixedly engaged to an underside of said upper plate and said second ball of said threaded rod being received in a second hole defined in said second base, a worm extending laterally through said cup so as to engage with said worm gear and said worm being driven by a motor, and a support extending from said lower plate and having a receiving portion defined therein, a supporting rod extending from said underside of said upper plate and having a third ball formed to a distal end thereof so as to be received in said receiving portion.

2. The golf practicing device as claimed in claim 1 wherein said upper plate has a plurality of holes defined in an upper surface thereof.

* * * * *